US006767125B2

(12) United States Patent
Midas et al.

(10) Patent No.: US 6,767,125 B2
(45) Date of Patent: Jul. 27, 2004

(54) KEYED PAINT CONTAINER HOLDER FOR A PAINT MIXER

(75) Inventors: Thomas J. Midas, Oak Park Heights, MN (US); Aaron Curtis, Eagan, MN (US); Daniel Schulz, St. Michael, MN (US)

(73) Assignee: Red Devil Equipment Company, Brooklyn Park, MN (US)

( * ) Notice: Subject to any disclaimer, the term of this patent is extended or adjusted under 35 U.S.C. 154(b) by 16 days.

(21) Appl. No.: 10/347,823

(22) Filed: Jan. 21, 2003

(65) Prior Publication Data

US 2004/0085855 A1 May 6, 2004

(51) Int. Cl.[7] ..... B01F 9/00; B01F 15/00
(52) U.S. Cl. ..... 366/209; 366/349; 366/605
(58) Field of Search ..... 366/209, 217, 366/208, 210, 211, 213, 349, 506

(56) References Cited

U.S. PATENT DOCUMENTS 1,831,888 A * 11/1931 Skillman ..... 366/211
2,022,527 A * 11/1935 Schletz ..... 366/211
2,735,663 A * 2/1956 Holt ..... 366/211
2,901,805 A * 9/1959 Stahl et al. ..... 366/211
3,301,534 A * 1/1967 Orser ..... 366/210
4,497,581 A * 2/1985 Miller ..... 366/208
5,050,996 A * 9/1991 Allen ..... 366/211
5,096,071 A * 3/1992 Neri ..... 366/605
5,197,802 A * 3/1993 Miller et al. ..... 366/217
5,507,574 A * 4/1996 Dickey ..... 366/213
5,788,371 A * 8/1998 Neri et al. ..... 366/217

* cited by examiner

*Primary Examiner*—Tony G Soohoo
(74) *Attorney, Agent, or Firm*—Faegre & Benson LLP

(57) ABSTRACT

A keyed paint container holder for paint mixers having a pivoting interlock key movable with respect to a paint container receptacle of the holder for orienting a rectangular footprint paint container to have a handle of the paint container in a corner of the holder adjacent the interlock key. The interlock key has first and second portions and is pivotable with respect to the holder to at least first and second positions and, optionally, to a third position. The holder accepts a cylindrical paint container as an alternative to the rectangular footprint paint container.

33 Claims, 11 Drawing Sheets

KEYED PAINT CONTAINER HOLDER FOR A PAINT MIXER

BACKGROUND OF THE INVENTION

This invention relates to the field of paint mixers, more particularly, to paint mixers suitable for mixing paint in rectangular containers as well as cylindrical containers.

In the past, paint was supplied at retail levels typically in one gallon cylindrical containers. Recently such paint has become available in rectangular containers, giving rise to the need for paint mixers to blend colors for paint in such rectangular containers. The rectangular paint container has a handle molded into one corner for the painter's convenience in pouring paint from the container. The rectangular paint container has a rectangular or square footprint or cross section. To accommodate the new paint container, a new holder can be provided in the paint mixer, suitable for receiving and retaining either the old cylindrical container or the new square footprint container. However, the new design of paint container results in a significant imbalance when the paint container is subject to the orbital and spinning motion desirable for paint mixing because of the molded handle resulting in a void or absence of paint in a region surrounding the handle in the corner of the container. When prior art mixers are used to mix paint in the square footprint paint container, unacceptable vibration will result unless steps are taken to address the unbalanced load caused by the molded in handle with its associated recess in one corner of the square or rectangular container.

The problem of addressing the unbalanced load is exacerbated when the holder allows the square container to be inserted into the holder with the handle in any of the four corners of the holder. The present invention overcomes this issue by providing a keyed paint container holder that allows placement of the square paint container in the holder with the handle in only one designated corner of the holder. The present invention accomplishes this without interfering with the capacity of the holder to receive the older style cylindrical paint container in the holder. In addition, the paint container holder of the present invention aligns the centers of gravity or inertia of the square and cylindrical paint containers in the holder with the spin axis of the mixer.

DETAILED DESCRIPTION OF THE INVENTION

Figure 1:
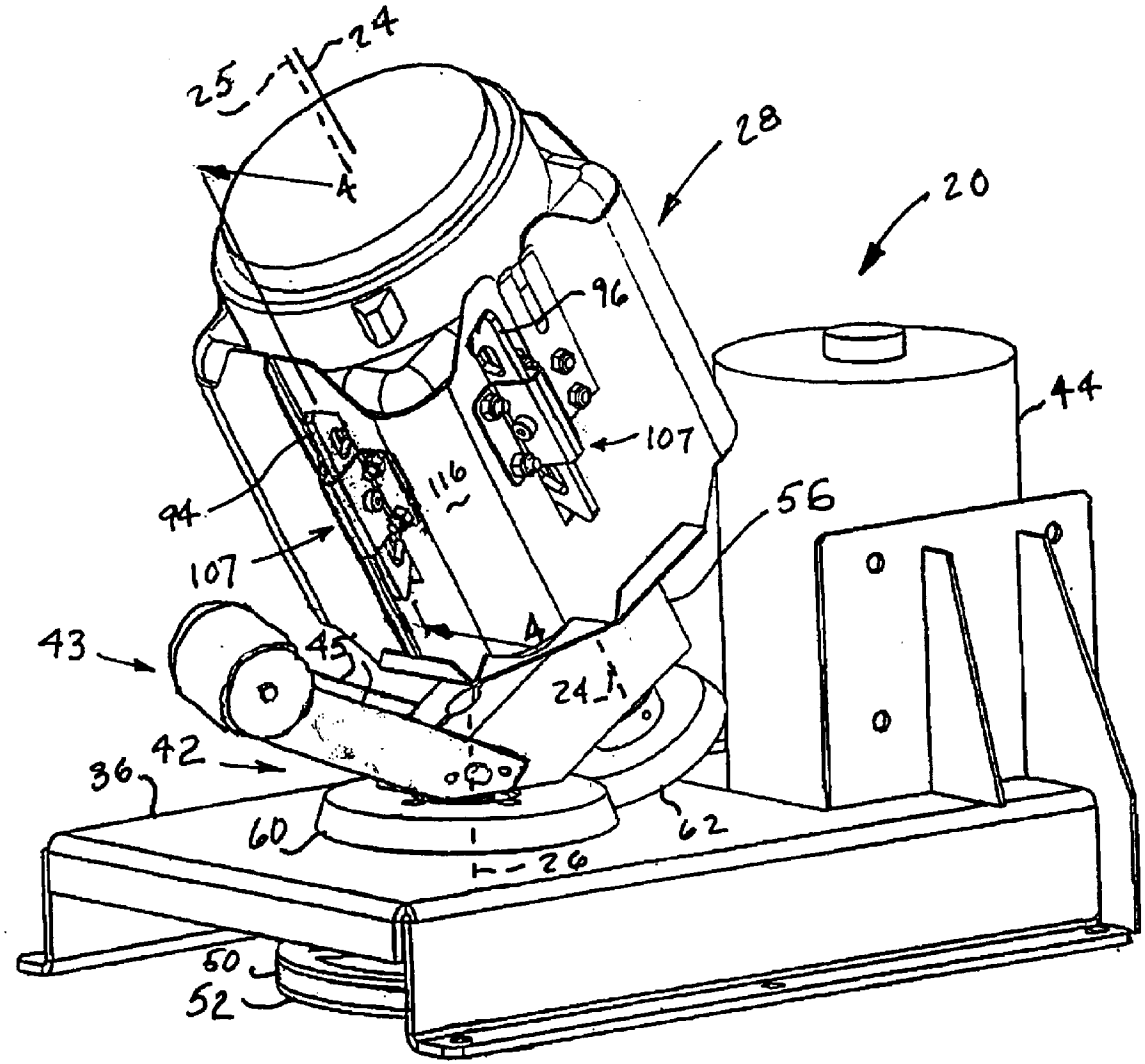
FIG. 1 is a perspective view of a portion of a paint mixer showing a paint container holder useful in the practice of the present invention.
Figure 2:
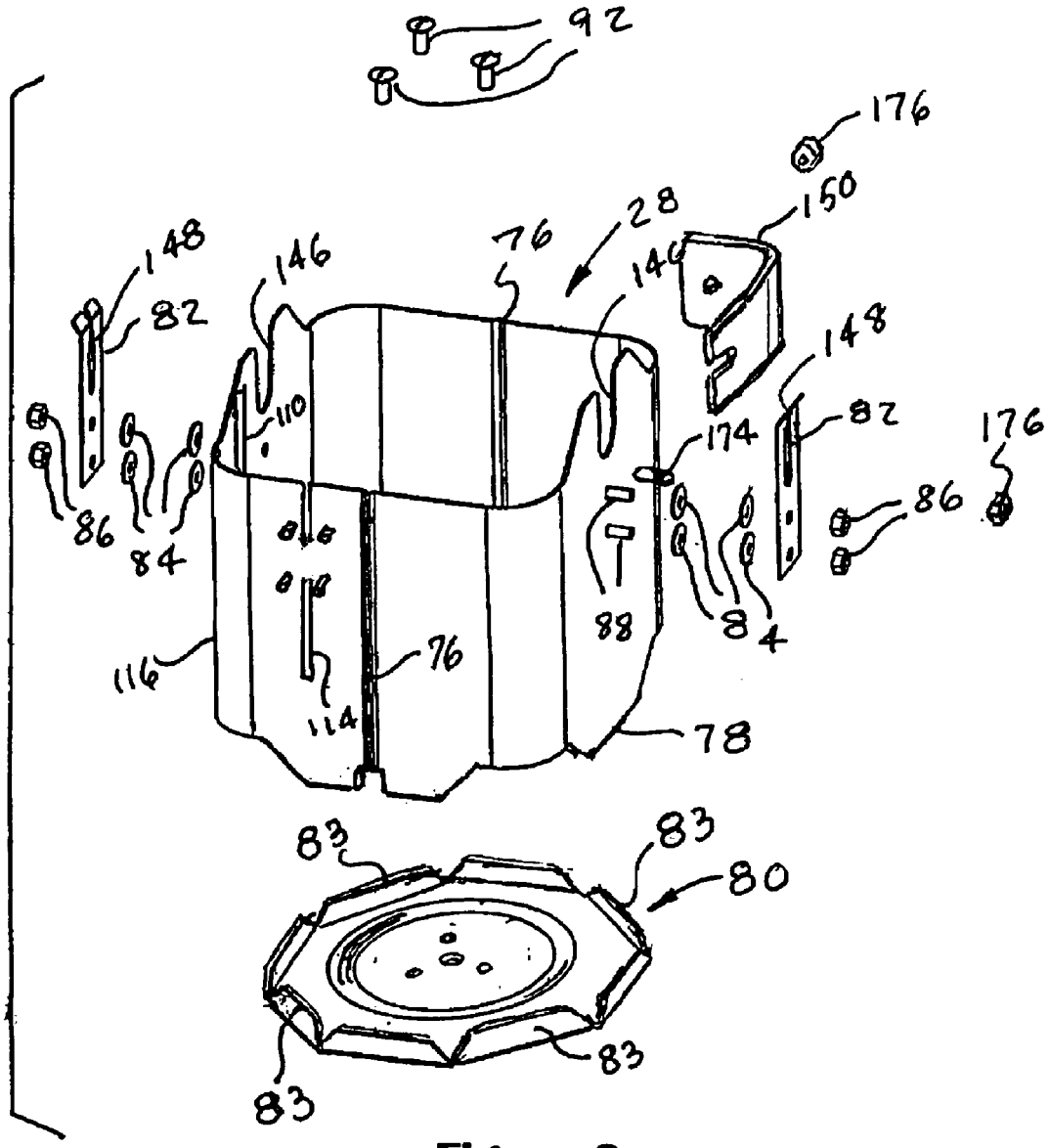
FIG. 2 is an exploded perspective view of the paint container holder of FIG. 1 with parts omitted to illustrate certain aspects of the present invention.

Referring to the Figures, and most particularly to FIGS. 1 and 2, a paint mixer apparatus 20 useful in practicing the present invention may be seen. Although not shown, it is to be understood that an enclosure is customarily provided to surround and enclose the mixer apparatus 20 shown in the drawings. The enclosure has a door for access to allow a user to insert and remove a paint container for mixing, and also preferably includes a door interlock switch and a timer, neither of which are shown herein. Mixer apparatus 20 rotates a paint container 22 about a first axis 24 (which is a central axis of the paint container 22), and planetates or orbits paint container 22 about a second axis 26. Paint container 22 may be a conventional one gallon cylindrical paint can (not shown in these Figures) or it may be a rectangular or square footprint paint container 22, shown separately in FIG. 3. Mixer 20 has a paint container holder assembly or apparatus 28 (shown in an exploded view in FIG. 2). Holder 28 is arranged to be able to hold either a conventional cylindrical one gallon paint can or the square footprint paint container 22. Mixer 20 is mounted on a mixing frame or support 36 which may be further supported in the enclosure (not shown).

Mixing frame 36 supports a driving mechanism 42 for the mixer 20. Driving mechanism 42 includes an electric motor 44 connected to a driven pulley 52 via a drive belt 50. In addition, driving mechanism 42 includes a planet gear shaft (not shown, but aligned with an axis 24). The planet gear shaft is journaled for rotation in an angled arm 56. Driving mechanism 42 further includes a planet gear 62 secured to the planet gear shaft which supports holder assembly 28 for rotation therewith. Axis 24 is thus seen to be a spin axis about which the paint container rotates for mixing paint. A sun gear 60 surrounds a shaft 54 (not shown, but aligned with axis 26). Sun gear 60 is fixed to mixing frame 36 and does not rotate. In operation, motor 44 rotates arm 56 via belt 50 and pulley 52. Because of the interengagement of sun gear 60 and planet gear 62, holder 28 will spin around on its own axis while at the same time orbiting around axis 26. One or more orbit counterweights 43 are preferably carried by counterweight arms 45. Arms 45 are secured to angled arm 56 for orbiting rotation therewith.

Figure 3:
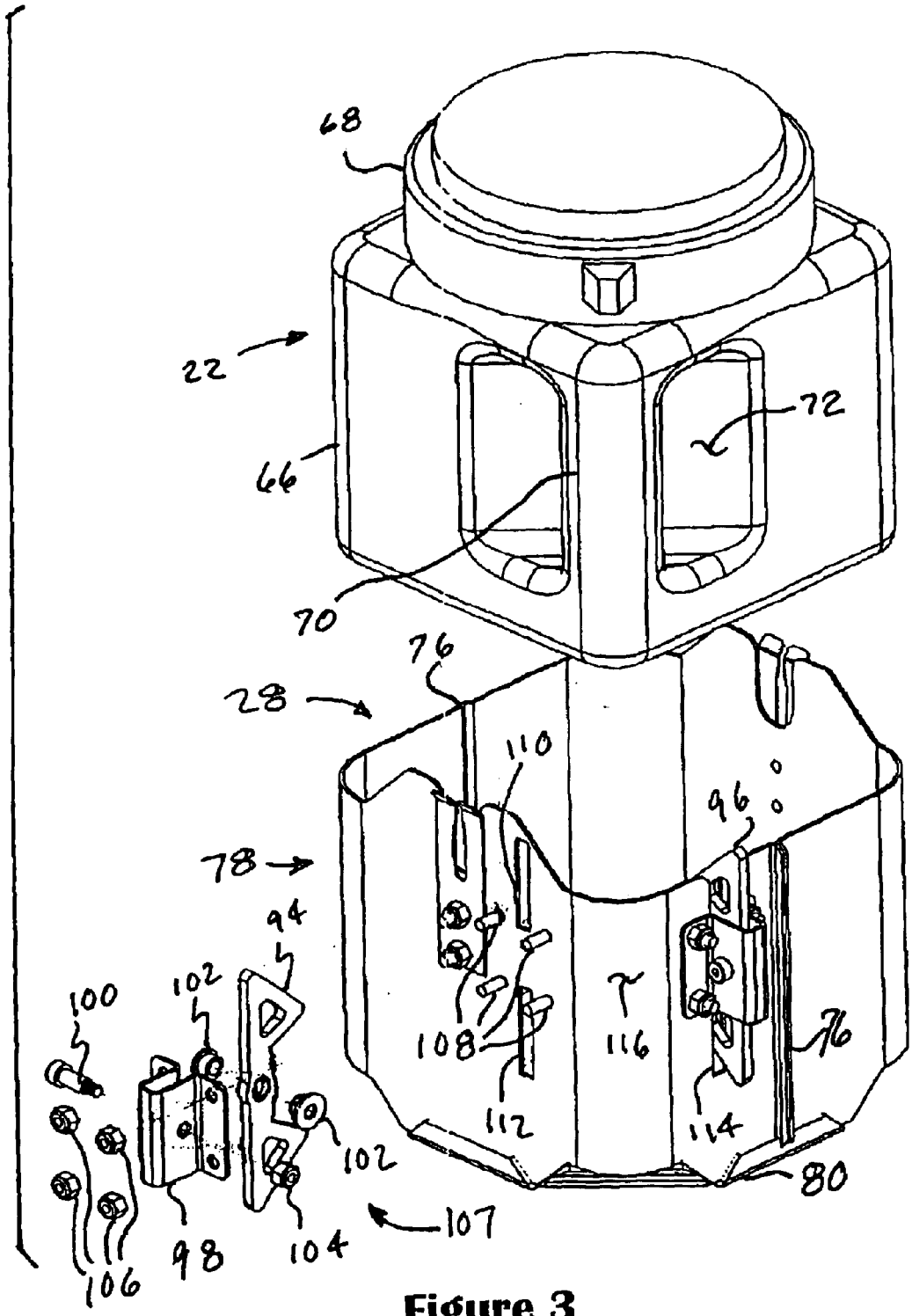
FIG. 3 is a perspective view of a square paint container and its handle together with the paint holder of FIG. 2 with certain parts exploded to illustrate aspects of the present invention.

Referring now to most particularly to FIGS. 2 and 3, paint container 22 has a generally square or rectangular body 66, typically having a square footprint or cross section as viewed from above. Container 22 also preferably has a threaded lid 68. One corner of container 22 has a handle 70 integrally formed therein forming an aperture 72. Because of handle 70 and aperture 72, container 22 does not have a symmetrically distributed inertia with respect to a geometrically centered axis or centroid 25 of container 22. Because of this eccentric inertial load, when container 22 (full of paint) is mixed using paint mixer 20 vibration will occur if container 22 is spun about centroid 25. The problem of variability of the unbalanced load is exacerbated when the square footprint container 22 can be inserted in the holder 28 in any of four positions, with the handle positioned in any one of the corners of the holder.

The keyed paint container holder 28 of the present invention is designed for use with parts from a model 5300 paint mixer available from the assignee of the present invention.

Referring now most particularly to FIG. 2, details of the paint container holder assembly 28 may be seen. FIG. 3 also shows holder assembly 28 with a pair of interlock key subassemblies 107, described infra. Assembly 28 has a pair of sheet metal sides 73, 74 welded together along seams 76 to form a unitary assembly or receptacle 78. A lower plate 80 is welded to the assembly 78. A pair of spring tabs 82 are secured to assembly 78 using washers 84 and locknuts 86 received on threaded bosses 88. Spring tabs 82 receive a wire bail when a cylindrical paint container is placed in holder 28, to prevent the paint container from slipping within holder 28 when holder 28 is rotated and spun to mix paint in the container. Assembly 28 is secured to a support on arm 56, preferably using screws 92. Receptacle 78 has a generally rectangular cross-section for receiving a corresponding rectangular footprint paint container. Both the receptacle and the paint container may be square.

The mixer 20 of the present invention provides a vortex mixing motion by tipping the paint container at an angle from the vertical and spinning the paint container about the spin axis 24 through the paint container, while at the same time rotating the container about the vertical axis 26 in an orbiting motion. The paint thus undergoes both a spinning and an orbiting motion. However, the recess or void 72 in paint container 22 that is molded into one corner of the square footprint paint container as a handle will cause an unbalanced load if the container 22 is spun about its centroid 25 without some form of compensation.

With an unbalanced load in the vortex mixer 20, vibration will occur. Without the present invention, such vibration can take various forms, depending on the orientation of the handle 70 with respect to the holder 28. The present invention provides at least one interlock key requiring the square footprint container 22 to be inserted into holder 28 with the handle in a specific, predetermined corner of the holder. In addition, the holder 28 is designed to align the spin axis 24 with the center of gravity or center of mass of each of the circular and square footprint paint containers.

The holder 28 is a generally square cross section receptacle 78 sized to receive the square footprint paint container 22. At least one and preferably two interlock keys 94, 98 are movably connected to the receptacle 78. The arrangement of key 94 will be described, with the understanding that the arrangement is substantially the same for key 96. Key 94 is mounted in a clip 98 for pivoting movement about an axle formed by a shoulder bolt 100. A pair of spacers 102 hold key 94 centered in clip 98. A nut 104 is received on bolt 100 to retain the key 94 in the clip 98 and four nuts 106 retain the parts as an interlock key assembly 107 to receptacle 78 via four threaded bosses 108. Key 96 is shown in a corresponding clip secured to receptacle 78. Slots 110 and 112 permit portions of key 94 to project into the interior of holder 28. Slot 114 similarly permits portions of key 96 to project into the interior of holder 28. As may readily be seen in FIGS. 1–3 and 8–11, the interlock key assemblies 107 are each proximate a predetermined corner 116 of the holder 28, with the corner 116 intermediate each of the pair of interlock key assemblies.

As described below, each interlock key assembly 107 permits full reception of the square footprint paint container 22 into the holder 28 when the handle 70 of the container 22 is in corner 116. In addition, the interlock key assembly 107 prevents such full reception of the container 22 when the handle 70 is not in corner 116. Finally, neither of the interlock key assemblies interferes with full reception of a cylindrical paint container into holder 28.

Figure 4:
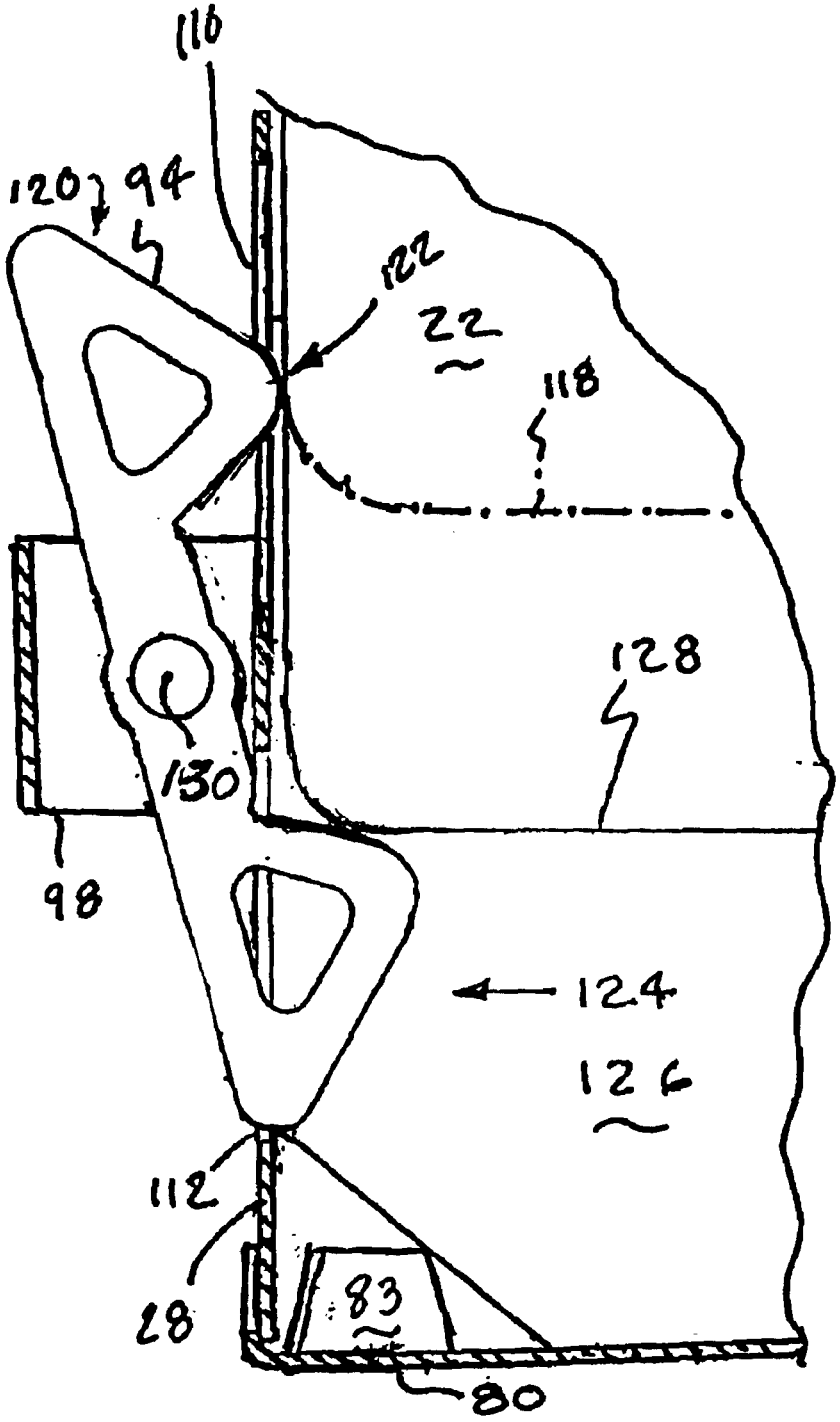
FIG. 4 is a fragmentary elevation section view taken along line 4—4 of FIG. 1 schematically showing the square paint container in a first position as it is received in the paint container holder with an interlock key in a first position, whether the handle of the square container is in a designated corner of the holder or not.

Referring now to FIG. 4, when a square footprint paint container 22 is initially beginning to be placed in or advanced into holder 28, a first portion 122 of the key 94 will be moved out of the interior of the receptacle 78 of holder 28 to move the key 94 to a first position 120 in response to contact between the interlock key 94 and the container 22 when the container 22 is initially received in receptacle 78 as shown at position 118. When key 94 is in the first position 120, a second portion 124 projects into the interior space 126 of the receptacle 78 of holder 28, as shown in FIG. 4. In the event that the handle 70 of the square footprint paint container 22 is in a corner other than corner 116, further entry or reception or advancement of container 22 into the receptacle 78 of holder 28 will be blocked by key 94 remaining in the first position 120, as shown in FIG. 4, with the paint container shown at an advanced position 128. In this condition, contact between a side of container 22 and the first portion 122 of key 94 will maintain second portion 124 in the interior space 126, preventing further entry of container 22 into holder 28. It is to be understood that in the absence of a paint container from the holder 28, key 94 is free to pivot about axis 130, thus providing a pivoting connection between key 94 and holder apparatus 28.

Figure 5:
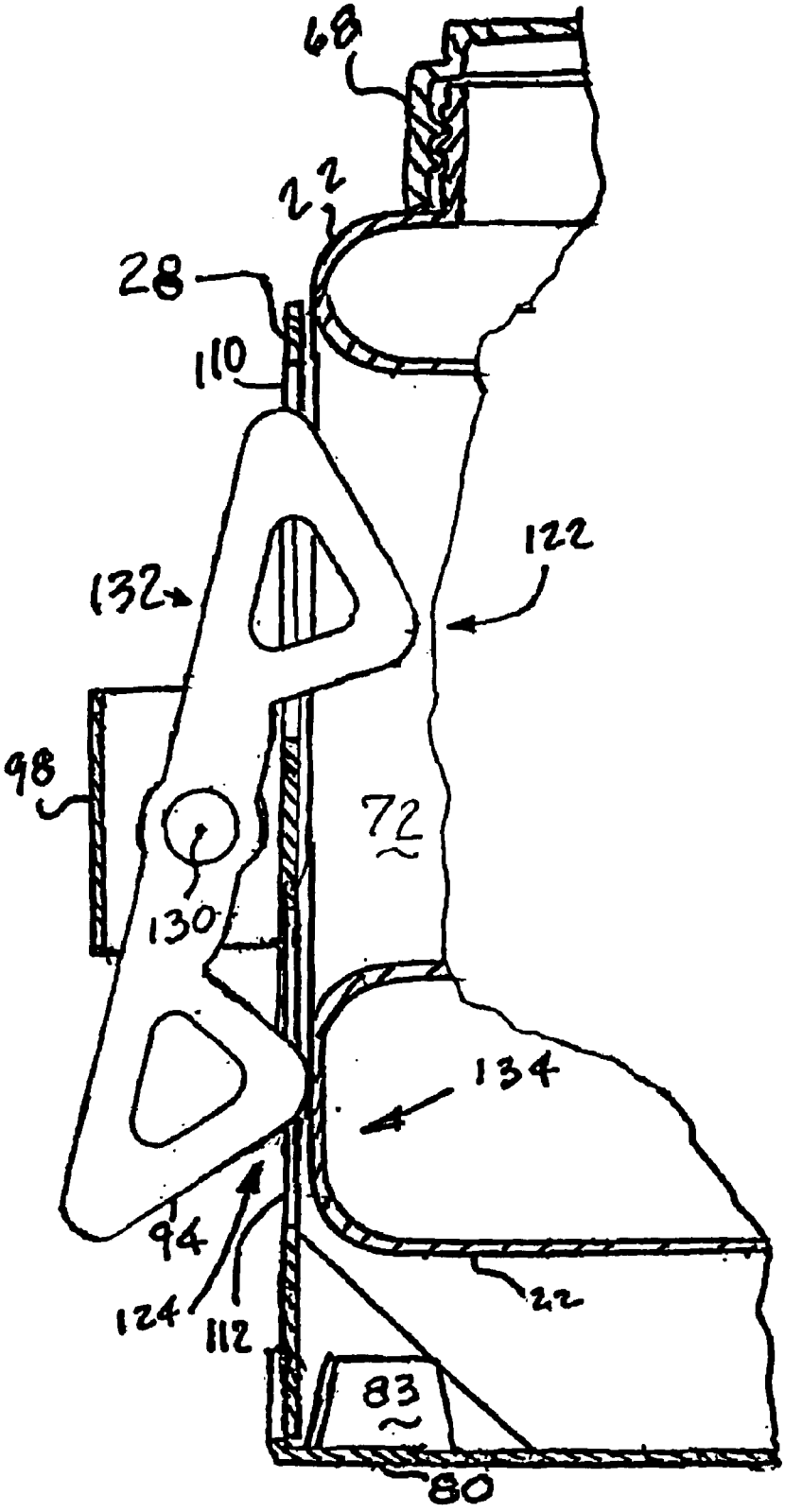
FIG. 5 is a fragmentary elevation section view similar to that of FIG. 4, except with the square paint container further advanced to a second position as it is received in the paint container holder and with the interlock key in a second position.

In the event that handle 70 is located in corner 116 when container 22 is entering holder 28, key 94 will be free to move to a second position 132, shown in FIG. 5, as container advances into the interior space 126 of holder 28. The key 94 will move to the second position in response to contact between the paint container 22 and the second portion 124 of the key 94 as the container progresses into the holder as indicated by position 134 of container 22 shown in FIG. 5. Key 94 will move to the second position 132 only when handle 70 is in corner 116, providing a space for the first portion 122 to enter the interior space 126 of holder 28 with the paint container 22 in position 134 because of aperture or recess 72 behind the handle 70 in container 22.

Figure 6:
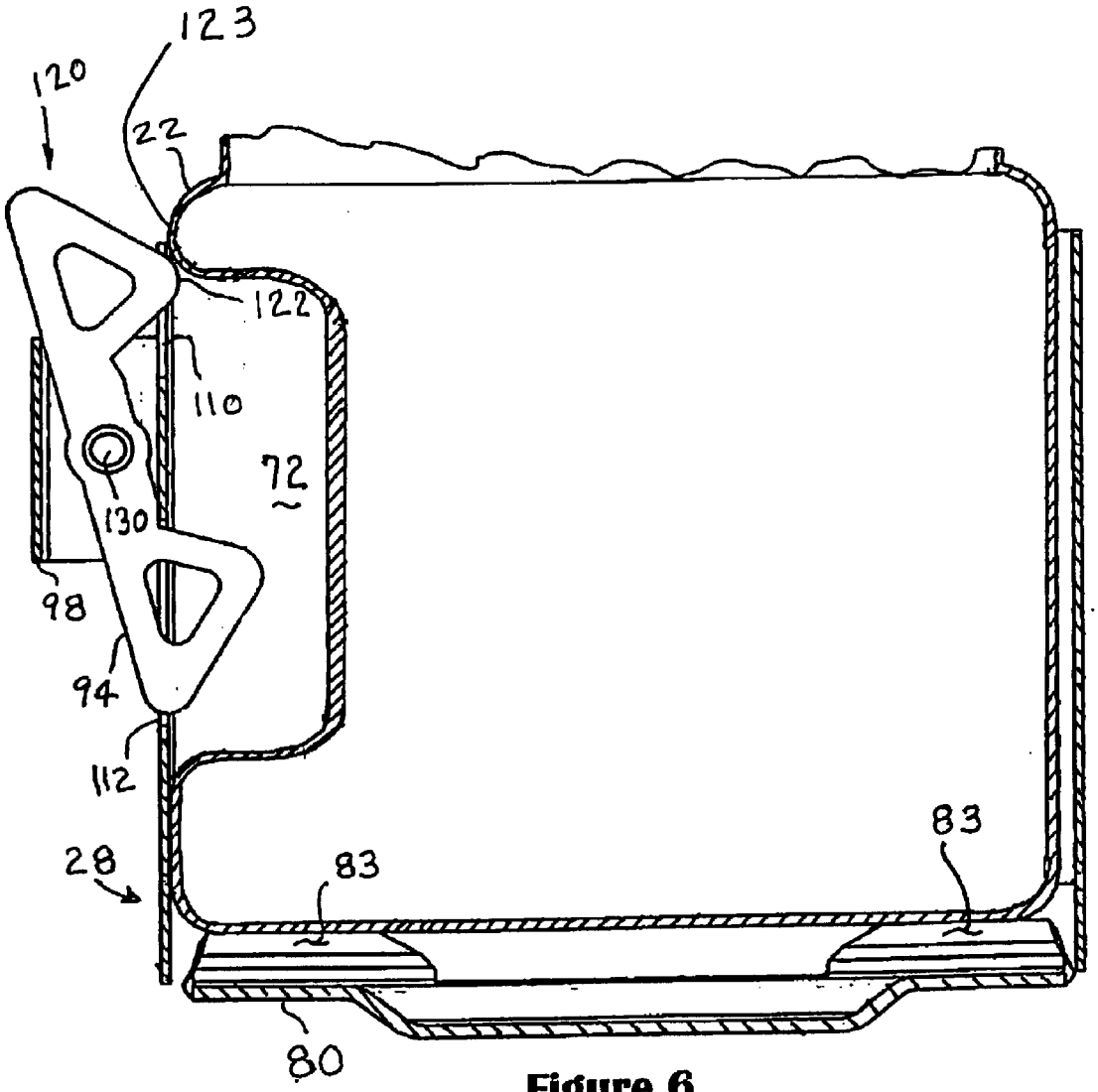
FIG. 6 is a fragmentary elevation section view similar to that of FIG. 5, except with the square paint container in a third position fully received in the paint container holder showing the interlock key in the first position.

In the embodiment shown in FIG. 6, the interlock key moves back to the first position upon complete reception of the rectangular paint container into the receptacle. This occurs because of a contact between the first portion 122 of the key 94 and an outwardly extending portion 123 of the paint container 22.

Referring now to 7, in an alternative embodiment, the parts may be arranged so that key 94 moves to a third position 136 intermediate the first and second positions 120, 132 in response to complete reception or advancement of the rectangular paint container 22 into the receptacle 78 when the handle 70 is in the corner 116 of the holder 28 adjacent the interlock key 94.

A still further alternative embodiment may utilize the second position 132 when the container 22 is fully received in holder 28, because the interlock key will perform the blocking function according to FIG. 4 when the handle is out of its proper position, and will provide the enabling function corresponding to that shown in FIG. 5 when the handle is in the proper position. In this embodiment, the enabling function position corresponding to that shown in FIG. 5 is extended to full reception of the container into the receptacle.

In connection with any of the embodiments described above, once the paint container 22 is fully seated in holder 28, the paint container 22 is ready to be agitated by mixer 20. In this condition, the container 22 rests on edges 83 of lower plate 80. It is also to be understood that it is desirable to have a definite position for the interlock key or keys when the paint mixer is operated, to fix (and thus allow more accurate compensation for) the effective inertial contribution of the key or keys during orbital mixing. In that regard, it is preferable, although not necessary, that the keys 94 and 96 are each made of a single piece of material.

Figure 7:
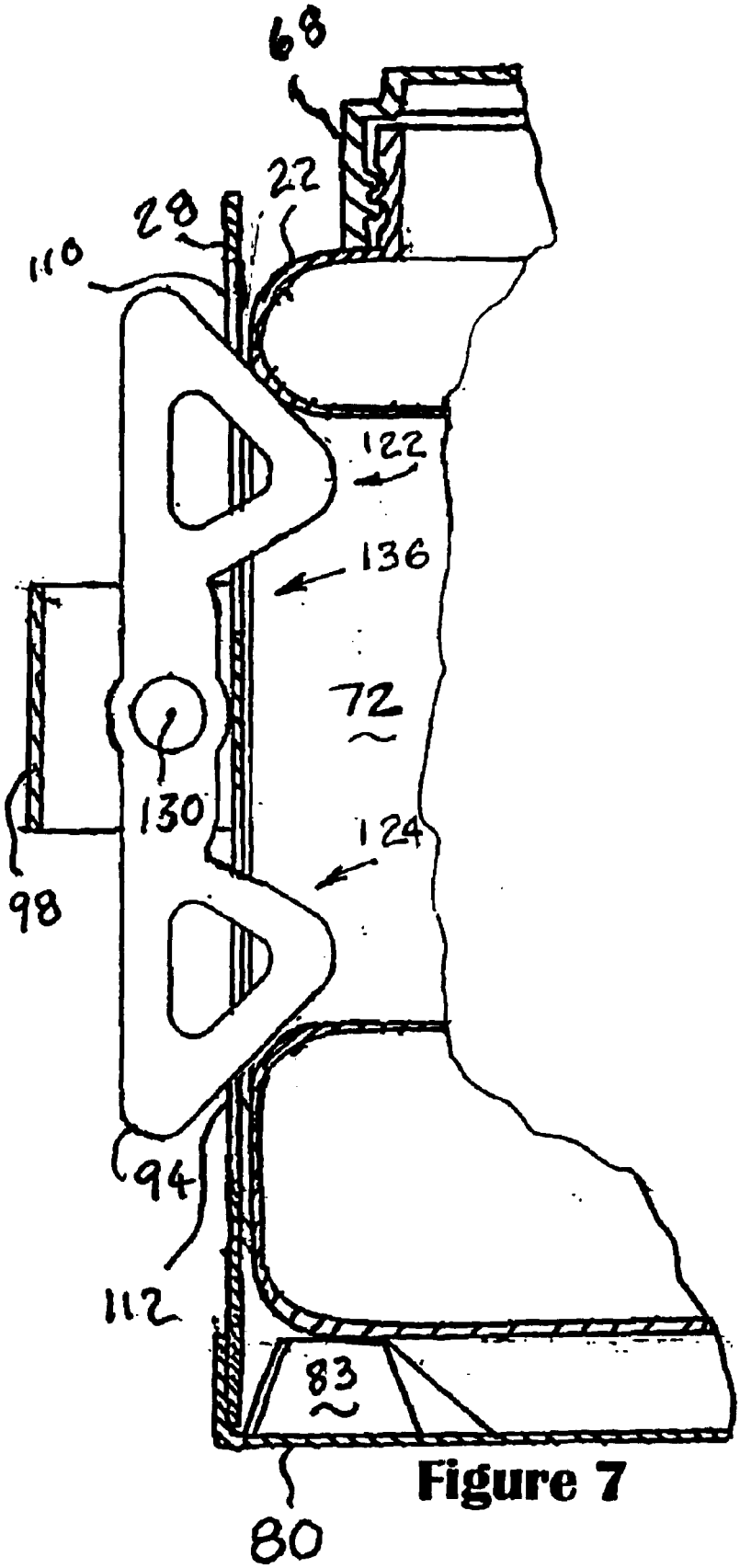
FIG. 7 is a fragmentary elevation section view similar to that of FIG. 6, with the square paint container in the third, fully seated position in the holder, and showing the interlock key in a third position intermediate the first and second positions.

Once the paint has been mixed and the container 22 is desired to be removed from holder 28, container 22 is moved from the full reception position (shown in FIG. 6 or 7) first to that shown in FIG. 5, and then fully removed, by passing through position 128 and then 118 shown in FIG. 4.

During this removal process, key 94 will operate in the following manner. In the first embodiment, key 94 moves from the first position 120 to the second position 132 and then again to first position 120 to allow container 22 to be withdrawn from holder 28. In the second embodiment, key 94 is in the third position 136 with the container 22 fully received in holder 28. As the container 22 is withdrawn from the holder, key 94 moves to the second position 132 as shown in FIG. 5, and then to the first position 120, as shown in FIG. 4. In the third embodiment, key 94 is in the second position 132 when the container 22 is fully received in holder 28. Key 94 will move to the first position 120 as the container is removed from receptacle 78 of holder 28.

Figure 8:
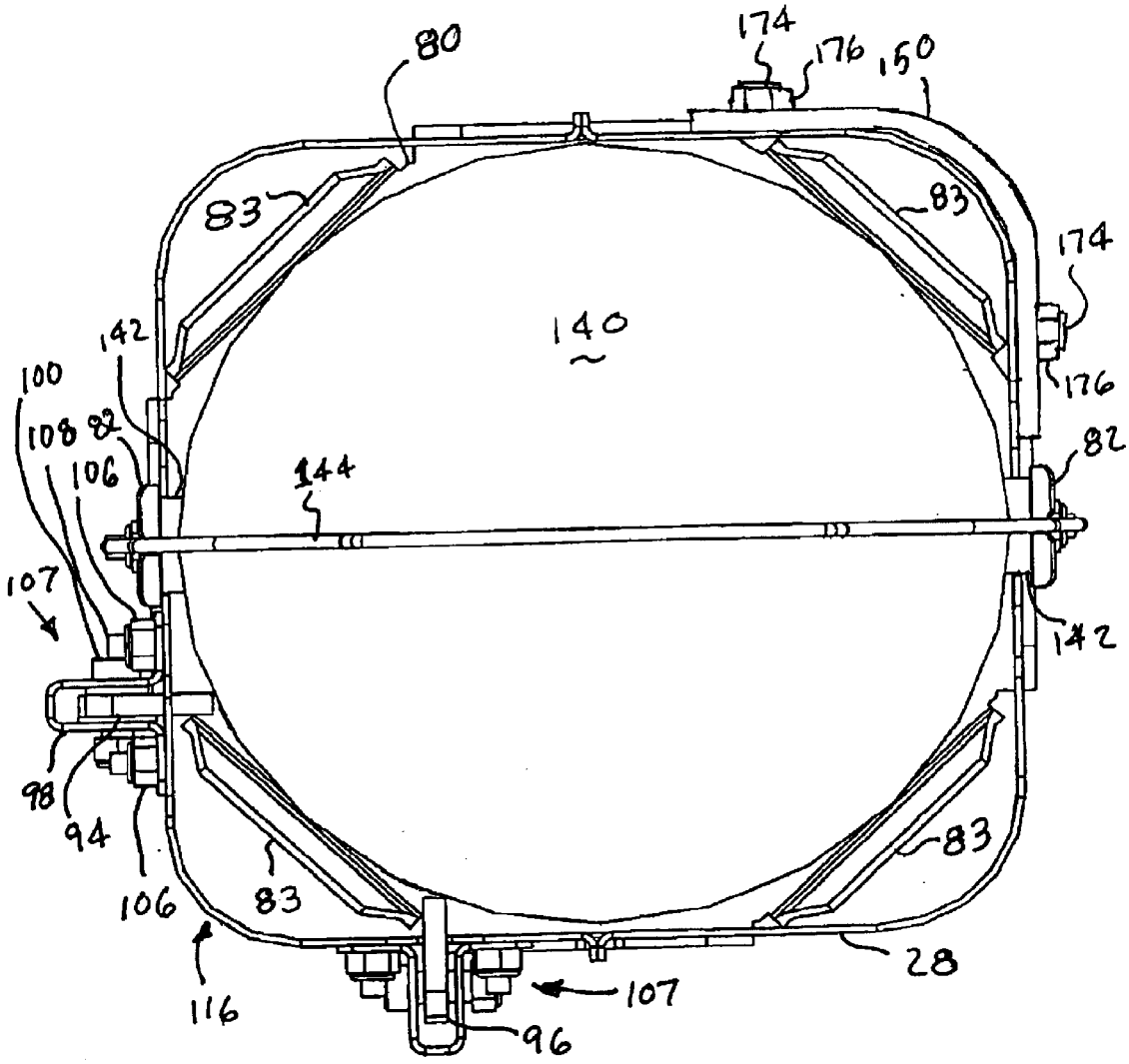
FIG. 8 is a top plan view of the paint container holder of FIG. 2 showing a cylindrical paint container received in the holder.
Figure 11:
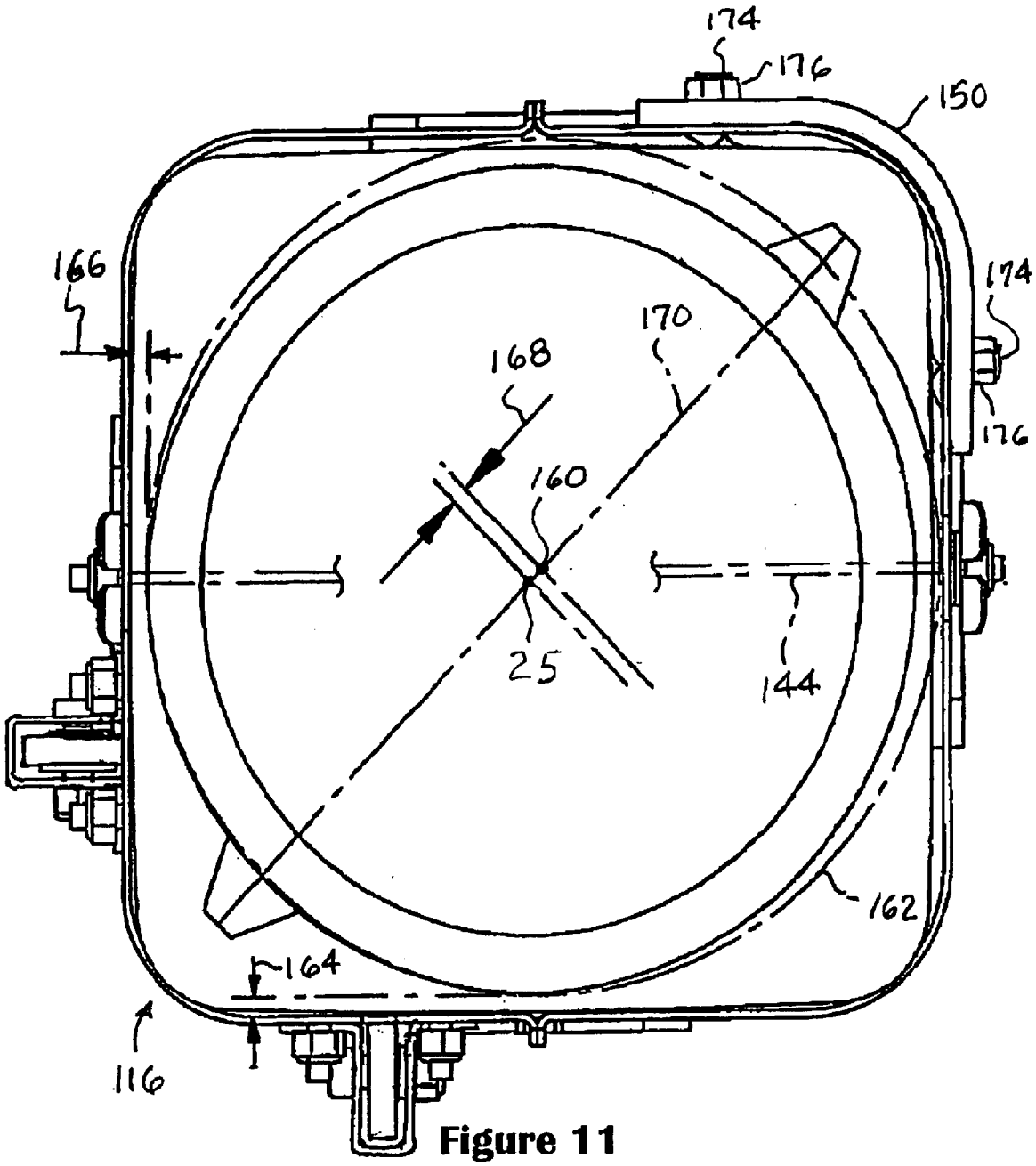
FIG. 11 is a top plan view showing an offset between the center of geometry of the paint container holder and the centers of gravity of the cylindrical and square paint containers.

Referring now to FIG. 8, a conventional cylindrical paint container 140 is shown received in holder 28 in a top plan view. In this view it may be seen that cylindrical container 140 will rest in the interior space 126 of holder 28 with keys 94 and 96 in the third position 136. The upper portion of cylindrical container 140 is oriented to holder 28 by a pair of bosses 142 and wire bail 144. The bosses 142 are received in grooves 146 (see FIG. 2), and the wire bail 144 is received in slots 148 in spring tabs 82. The lower portion of cylindrical container 140 is oriented to holder 28 by edges 83 of plate 80. As may be seen most clearly in FIG. 11, the cylindrical paint container 140 is held away from corner 116 by the apparatus described above to position the center of mass 160 of the cylindrical container 140 on the spin axis 24. The outline of the cylindrical container 140 in FIG. 11 is shown by chain line 162. First and second offsets 164 and 166 move the center of mass 160 of container 140 a distance 168 along a plane of symmetry 170 extending diagonally across the interior space 126 of holder 28.

Figure 9:
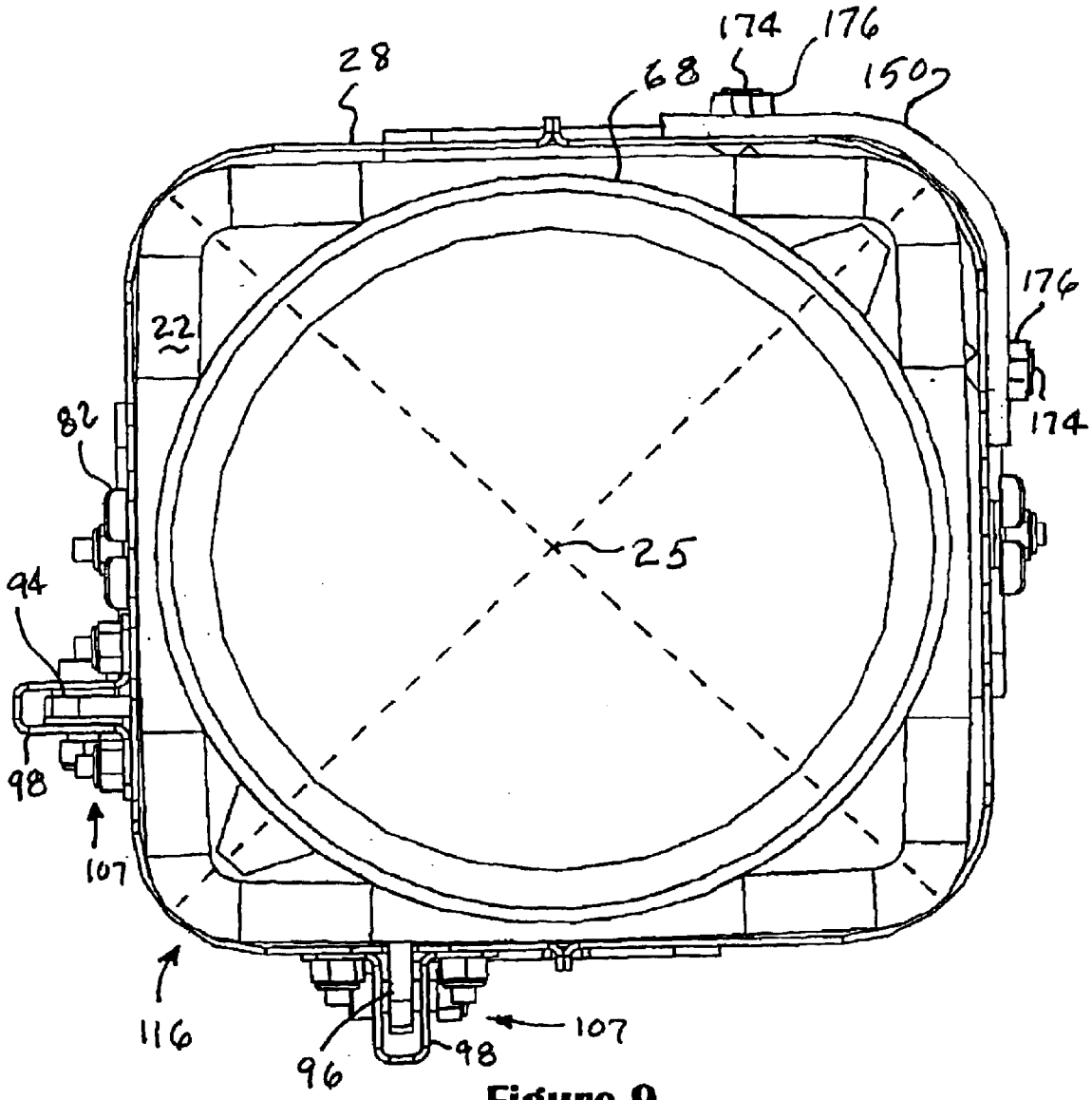
FIG. 9 is a top plan view of the paint container holder of FIG. 2 showing a square footprint paint container received in the holder.

FIG. 9 shows a top plan view of the square footprint paint container 22 fully received in holder 28. The center of geometry 25 of square container 22 is shown at the intersection of diagonals from the corners of container 22. Referring also to FIG. 11, it may be seen that contact between the inside corners of holder 28 and the outside corners of container 22 positively locates the rectangular or square container 22 in holder 28, with the handle 70 and aperture or void 72 intermediate the keys 94 and 96. In the position shown, the center of mass of the container 22 is located at point 160, at the distance 168 from the center of geometry 25 of container 22, because of the absence of paint in recess 72. Container 22 is thus held in a position where its center of mass is located at point 160 which is also coincident with the spin axis 24.

Figure 10:
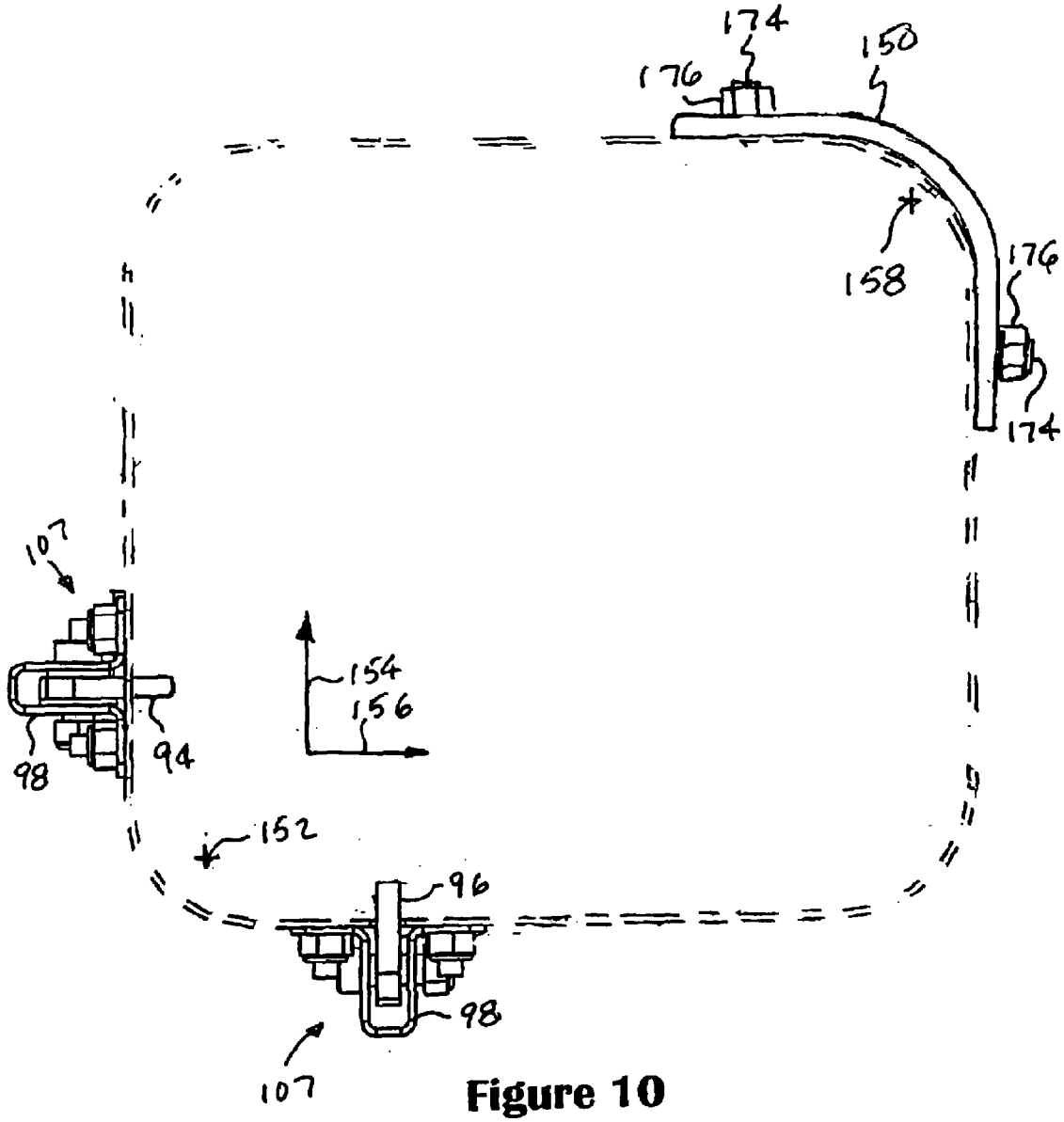
FIG. 10 is a top plan outline view of the paint container holder of FIG. 2 showing details of the centers of mass for the interlock key assembly set and a diametrically located counterweight useful in the practice of the present invention.

Referring now to FIGS. 2, and 8–11, a counterweight 150 is may be added to holder 28 in a corner diagonally opposite to corner 116 intermediate the interlock key assemblies 107. Counterweight 150 is preferably in the form of an angle bracket secured to holder 28 using conventional studs 174 and nuts 176. FIG. 10 indicates a location 152 for the center of mass of the pair of interlock key assemblies 107. The location 152 is 2.4 inches from the spin axis 24 in both directions 154 and 156. The approximate mass of the pair of interlock key assemblies is 0.5 pounds. A location 158 for the center of mass of the counterweight 150 is 3.1 inches from the spin axis 24 in both directions opposite to directions 154 and 156. The mass of counterweight is approximately 0.4 pounds.

This invention is not to be taken as limited to all of the details thereof as modifications and variations thereof may be made without departing from the spirit or scope of the invention. For example and not by way of limitation, it is within the scope of the present invention to use only one key and interlock key assembly. Furthermore, again by way of example and of limitation, the one key or pair of keys can have a straight sided second portion instead of projecting second portion and still provide the benefits and be within the scope of the present invention.

What is claimed is:

1. A keyed paint container holder apparatus for a paint mixer adapted to receive a rectangular footprint paint container having a recess in a corner of the container forming a handle, the keyed paint container holder apparatus comprising:

a. a generally rectangular cross-section receptacle for receiving a corresponding rectangular footprint paint container;

b. an interlock key movably connected to the receptacle to:

i. enable partial reception of the paint container into the receptacle when the interlock key moves to a first position in response to contact between the interlock key and the paint container;

ii. enable further reception of the paint container into the receptacle when the handle is in a corner of the holder adjacent the interlock key and the interlock key moves to a second position in response to contact between the paint container and the key during such further reception of the paint container into the receptacle, and iii. block such further reception of the paint container into the receptacle when the handle is not in the corner of the holder adjacent the interlock key such that the interlock key is held in the first position by the paint container.

2. The apparatus of claim 1 wherein the interlock key moves to the first position in response to complete reception of the paint container into the receptacle when the handle is in the corner of the holder adjacent the interlock key.

3. The apparatus of claim 1 wherein the interlock key remains in the second position upon complete reception of the paint container into the receptacle when the handle is in the corner of the holder adjacent the interlock key.

4. The apparatus of claim 1 wherein the interlock key moves to a third position intermediate the first and second positions in response to complete reception of the paint container into the receptacle when the handle is in the corner of the holder adjacent the interlock key.

5. The apparatus of claim 1 further comprising a pivoting connection between the interlock key and the holder apparatus.

6. The apparatus of claim 1 wherein the interlock key has a first portion in contact with the paint container when the paint container is partially received in the receptacle.

7. The apparatus of claim 6 wherein the interlock key is moved to the first position by contact between the paint container and the first portion of the interlock key when the paint container is initially received in the receptacle.

8. The apparatus of claim 7 wherein the interlock key has a second portion which projects into an interior space of the receptacle while the interlock key is in the first position to block the further reception of the paint container when the handle is not in the corner of the holder adjacent the interlock key and the interlock key is in the first position.

9. The apparatus of claim 8 wherein the first and second portions of the interlock key are formed of single piece of material.

10. The apparatus of claim 8 wherein the first portion moves the second portion into the interior space of the receptacle when the interlock key is in the first position.

11. The apparatus of claim 8 wherein the second portion moves the first portion into the interior space of the receptacle when the handle is in the corner of the holder adjacent the interlock key and the interlock key is moved to a second position by advancement of the paint container into the receptacle.

12. The apparatus of claim 11 wherein the second portion moves out of the interior space of the receptacle when the handle is in the corner of the holder adjacent the interlock key and the paint container is further advanced into the receptacle.

13. The apparatus of claim 8 wherein the second portion prevents further reception of the paint container into the receptacle when the handle is not in the corner of the holder adjacent the interlock key such that a side of the paint container restrains the first portion from entering the interior of the receptacle.

14. The apparatus of claim 8 wherein the second portion of the interlock key projects into the interior of the receptacle when the paint container is fully received in the receptacle and the handle is in the corner of the holder adjacent the interlock key.

15. The apparatus of claim 8 wherein the first portion of the interlock key projects into the interior of the receptacle when the paint container is fully received in the receptacle and the handle is in the corner of the holder adjacent the interlock key.

16. The apparatus of claim 8 wherein both the first and second portions of the interlock key project into the interior of the receptacle when the paint container is fully received in the receptacle and the handle is in the corner of the holder adjacent the interlock key.

17. The apparatus of claim 1 wherein the receptacle has a square cross section.

18. The apparatus of claim 1 wherein the rectangular cross-section of the receptacle is sized to receive a cylindrical paint container as an alternative to the rectangular paint container.

19. A keyed paint container holder apparatus for a paint mixer adapted to receive a square footprint paint container having a recess in a corner of the container forming a handle, the keyed paint container holder apparatus comprising:

a. a generally rectangular cross-section receptacle for receiving a corresponding rectangular footprint paint container;

b. a pair of interlock key assemblies, each located proximate a corner of the receptacle such that the corner is intermediate the interlock key assemblies and each assembly has an interlock key movably connected to the receptacle to:

i. enable initial reception of the paint container into the receptacle when the interlock keys move to a first position in response to contact between the interlock keys and the paint container;

ii. enable further reception of the paint container into the receptacle when the handle is in the corner of the holder intermediate the interlock key assemblies and when the interlock keys each move to a second position in response to contact between the paint container and the keys during such further reception of the paint container into the receptacle, and iii. block such further reception of the paint container into the receptacle when the handle is not in the corner of the holder intermediate the interlock key assemblies such that the interlock keys are held in the first position by the paint container.

20. The apparatus of claim 19 wherein the interlock keys each move to the first position upon full reception of the rectangular footprint paint container into the receptacle.

21. The apparatus of claim 19 wherein the interlock keys each remain in the second position as the rectangular footprint paint container is fully received into the receptacle.

22. The apparatus of claim 19 wherein the interlock keys each move to a third position intermediate the first and second positions upon full reception of the rectangular footprint paint container into the receptacle.

23. The apparatus of claim 19 further comprising a counterweight located at a corner of the receptacle diagonally opposite to the corner intermediate the interlock key assemblies.

24. The apparatus of claim 19 wherein the receptacle has a generally square cross-section.

25. The apparatus of claim 19 wherein the rectangular cross-section of the receptacle is sized to receive a cylindrical paint container as an alternative to the rectangular paint container.

26. A method of orienting a paint container in a rectangular receptacle of an orbital type paint mixer comprising the steps of:

a. initially receiving a generally rectangular paint container into the receptacle and moving an interlock key to a first position in response to contact between the interlock key and the rectangular paint container;

b1. further receiving the paint container into the receptacle when a handle of the paint container is in a corner of the receptacle adjacent the interlock key and the interlock key moves to a second position in response to contact between the paint container and the key during such further reception of the paint container into the receptacle, and alternatively b2. blocking such further receiving of the paint container into the receptacle when the handle is not in the corner of the holder adjacent the interlock key and the interlock key is held in the first position by the paint container.

27. The method of claim 26 further comprising an additional step following step b1., the additional step comprising:

c. moving the interlock key to the first position as the rectangular paint container is fully received in the receptacle.

28. The method of claim 26 wherein the interlock key remains in the second position as the paint container is fully received in the receptacle.

29. The method of claim 26 further comprising an additional step following step b1., the additional step comprising:

c. moving the interlock key to a third position intermediate the first and second positions as the rectangular paint container is fully received in the receptacle.

30. The method of claim 26 wherein step b1. further includes receiving the interlock key in a recess adjacent the handle of the paint container.

31. The method of claim 26 further comprising an additional step following step b1., the additional step comprising:

c. completely receiving the paint container into the receptacle when the handle of the paint container is in a corner of the receptacle adjacent the interlock key.

32. The method of claim 31 further comprising the additional steps of:

d. withdrawing the generally rectangular paint container completely from the receptacle, and e. completely receiving a cylindrical paint container into the receptacle.

33. The method of claim 32 wherein the interlock key moves to a third position intermediate the first and second positions in step e.

* * * * *